United States Patent [19]

Oakes

[11] 4,259,808

[45] Apr. 7, 1981

[54] MAGNETIC OPTICAL TOY

[76] Inventor: Harry S. Oakes, 74 Smithbridge Rd., Glen Mills, Pa. 19342

[21] Appl. No.: 90,650

[22] Filed: Nov. 2, 1979

[51] Int. Cl.[3] ..... A63H 33/26

[52] U.S. Cl. ..... 46/240; 350/4.2; 272/8 M; 353/2

[58] Field of Search ..... 46/240, 239, 238, 236, 46/1 R; 40/426; 350/4.1, 4.2; 353/1, 2; 272/8 M, 8 D, 8 R, 8 N; 273/1 M; 35/19 A

[56] References Cited

U.S. PATENT DOCUMENTS

| | | | |
|---|---|---|---|
| 1,728,610 | 9/1929 | Horton | 272/8 M |
| 3,422,562 | 1/1969 | Green | 46/240 X |
| 3,860,324 | 1/1975 | Gonzalez | 350/4.2 |
| 3,883,988 | 5/1975 | Fields | 46/239 |

FOREIGN PATENT DOCUMENTS

| | | | |
|---|---|---|---|
| 408743 | 1/1945 | Italy | 350/4.1 |

*Primary Examiner*—Gene Mancene
*Assistant Examiner*—Mickey Yu

[57] ABSTRACT

A Magnetic Optical Toy comprising a mirrored viewing chamber, various ferrous metal pieces lying randomly and freely within the mirrored viewing chamber, a movable magnet against and about the exterior surface of the mirrored chamber, and a viewing area into the mirrored chamber allowing the observation of the interior of the mirrored chamber with both eyes of the observer in order to perceive a three dimensional image.

As the magnet is moved against and about the outside surface of the internally mirrored chamber various shapes and sizes of ferrous metal pieces are attracted and otherwise moved within the mirrored chamber and form a random design pattern which is reflected in the mirrored chamber resulting in a viewable three dimensional reflected design configuration. The design configuration changes as the magnet is manipulated by the observer.

1 Claim, 5 Drawing Figures

MAGNETIC OPTICAL TOY

This invention relates to a mirror reflecting design apparatus and specifically to the use of a movable magnet means against and about the external surface of an internally mirrored chamber to attract and otherwise effect the positions of movable ferrous metal pieces to form a plurality of reflected design patterns of said ferrous metal pieces resulting in a viewable three dimensional image.

Heretofore mirror reflecting design toys known as kaleidoscopes have used cardboard or plastic tubes containing two mirrors at an angle of thirty degrees to each other and running the inside length of said tubes. The viewing end of these devices are closed except for a small circular viewing hole for one eye viewing. The other end of said tubes usually have a movable tube portion consisting of a translucent disk to allow light to enter and an assortment of pieces of various colored materials that reflect in said mirrors and make a two dimensionally viewable design pattern. There have been various types of design creating parts of these devices; they include: interchangeable tube ends, dome shaped ends, spinable ends, and one device that uses a lens to magnify any viewed object and reflect it into a design pattern. Another related toy uses two angled mirrors and a rotatable disk at the base of said mirrors on which a design is drawn and reflected in said mirrors. All these configurations of prior art produce a viewed two dimensional image.

Accordingly the objects of my invention are the following: A viewable three dimensional design capability through the manipulation of a magnet means against and about the exterior surfaces of an internally mirrored chamber to attract and otherwise change the position of various ferrous metal design element pieces contained within said mirrored chamber resulting in a viewable three dimensional reflected design image.

The further objects of my invention will be more clearly understood when referring to the specification to follow.

DESCRIPTION

Figure 1:
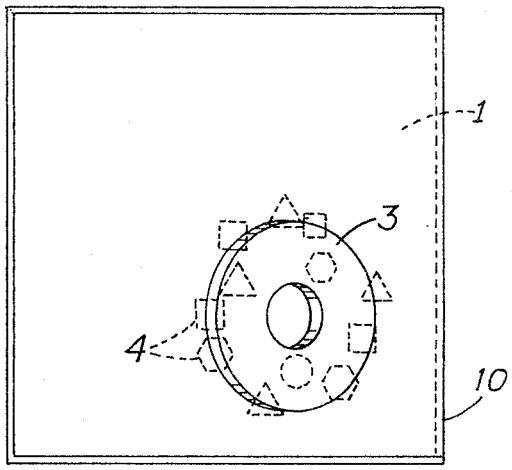
FIG. 1 is a diagram illustrating the side view of the device showing randomly placed magnet (3) on the exterior surface of one side (1) of internally mirrored viewing chamber.
Figure 2:
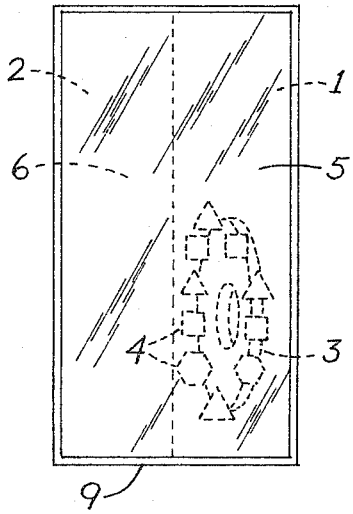
FIG. 2 is a diagram of the front of the device showing the ferrous metal design element pieces (4) attracted to the interior surface of the mirrored viewing chamber and a transparent cover (5) over the mirrored viewing chamber (6).
Figure 3:
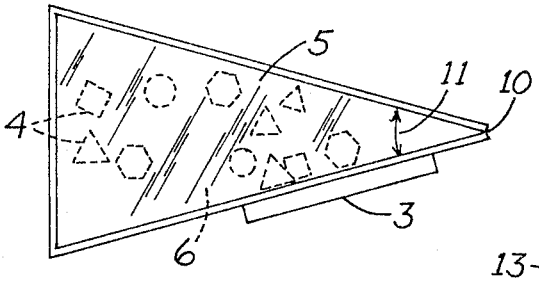
FIG. 3 is a diagram of the top view of the device showing the transparent cover (5) over the mirrored viewing chamber (6) and ferrous metal pieces (4) lying randomly at the bottom (9) of the device. Magnet (3) is shown against the outside surface of the mirrored chamber (6) and ferrous metal pieces (4) attracted to the inside surface of mirrored panel (1).
Figure 4:
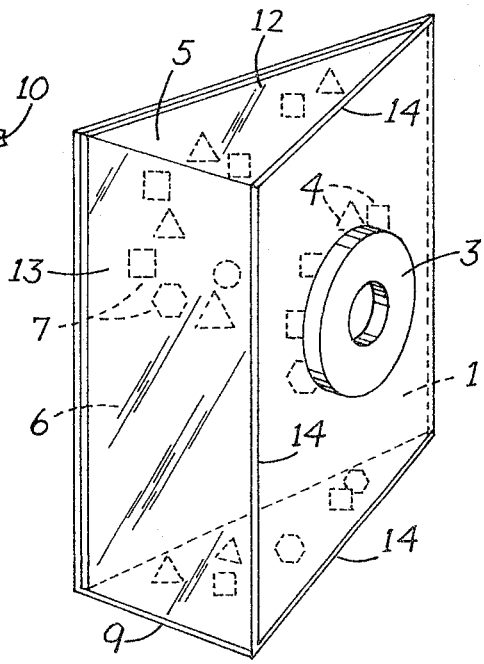
FIG. 4 is a perspective view of the device showing reflected images (7) magnet (3) at random position on outside of mirrored chamber surface (1) with ferrous metal pieces (4) attracted to the inside surface of the mirrored chamber (6) transparent cover (5) over mirrored viewing chamber (6).
Figure 5:
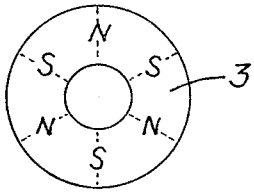
FIG. 5 is a diagram of polarization of magnet (3).

A Magnetic Optical Toy comprising two mirrored surfaces (1&2 FIG. 2) facing each other and adjacent along a straight edge (10 FIG. 3) to form an angle of 30° (11 FIG. 3) and creating a triangular prism shaped chamber (6 FIG. 3) between said two mirrored surfaces; said mirrored surfaces made from two pieces of plastic material joined precisely along one straight edge each by solvent gluing means; said two mirrored surfaces to be of a vacuum silver plated plastic material; a transparent covering means (5 FIG. 2) to span top (12), front (13) and base (9 FIG. 4) of said triangular prism shaped mirrored chamber whereas said transparent covering material is thermoformable clear plastic shaped to conform to the edges (14 FIG. 4) of top, front and base of said mirrored panels forming said mirrored chamber; said transparent covering material attached to said edges by solvent gluing means; the containment within said mirrored chamber of various shapes and sizes of ferrous metal pieces (4 FIG. 4) and lying freely within said mirrored chamber; said ferrous metal pieces to be coated with colored plastic or painted; a magnet means (3 FIG. 5) to be a ring shaped disk polarized in six equal segments where each segment is oriented North/South in an annular manner (FIG. 5); the said magnet means to be of sufficient strength to attract said metal pieces and sufficient lightness in weight to hold attracted said ferrous metal pieces in an elevated position on the inside surface of said mirrored chamber without the unaided said magnet means falling free from the outside surface of said mirrored chamber.

The Magnetic Optical Toy is hand held or placed on a flat surface by an operator and while looking through the transparent cover (5 FIG. 4) of said mirrored chamber (6 FIG. 4) and into said mirrored chamber, the said operator holds the magnet means (3 FIG. 4) in his hand and manipulates said magnet means against and about the exterior surfaces of said mirrored chamber resulting in the said ferrous metal pieces (4 FIG. 4) being attracted and otherwise moved about the inner volume of the said mirrored chamber thus forming at various positions, design patterns which are reflected, in a symmetrically repeated manner, in the said two adjacent mirrors. When the said magnet means is moved to elevated positions in relation to the base of said mirrored chamber and attracting the said ferrous metal pieces to these same said elevations and then the magnet means is removed the said ferrous metal pieces freely drop resulting in a reflected, symmetrically repeated design pattern being formed at the base of the said mirrored chamber. By observing at sufficiently close range so as to see the reflected design configuration with both of the said observer's eyes a three dimensional image is perceived by said observer. The three dimensional design image is effective when viewed from above and looking down into the mirrored chamber or when viewed from the front of the device into the mirrored chamber. The best results are achieved when the said mirrored chamber is oriented toward an adequate light source so as to put as much light as possible into the said mirrored chamber.

Further, it will be clear that the embodiment of the Magnetic Optical Toy Invention which has been described may be changed in many ways, some of them have been indicated and such changes do not effect the essence of the invention as described in the annexed claims.

I claim as new:

1. A Magnetic Optical Toy comprising:

two opposed mirrors joined along a straight edge and angled in order to reflect symetrically repeated images;

a transparent cover enclosing the space between the two opposed mirrors;

ferrous metal pieces of various shapes and sizes operationally enclosed within the space between the two opposed mirrors by the transparent cover; and a magnet adapted to be maneuvered against the exterior surface area of the two opposed mirrors and the transparent cover to attract and otherwise move the ferrous metal pieces through the interaction of the magnetic field of the magnet with the ferrous metal pieces to form design patterns between the two opposed mirrors and reflected, symetrically repeated design pattern images in the two opposed mirror surfaces.

* * * * *